United States Patent [19]

Franco

[11] 3,967,668

[45] July 6, 1976

[54] CARRIER FOR LOOSE ARTICLES

[76] Inventor: Jack D. Franco, c/o Franco Mfg. Co., 309 5th Ave., New York, N.Y. 10001

[22] Filed: Dec. 5, 1974

[21] Appl. No.: 529,949

[52] U.S. Cl. ..... 150/52 R

[51] Int. Cl.[2] ..... B65D 65/10

[58] Field of Search ..... 150/1.7, 11, 33, 52 R; 190/1, 2, 42; 224/5 Q, 26 R

[56] References Cited

UNITED STATES PATENTS

| | | | |
|---|---|---|---|
| 1,123,609 | 1/1915 | Spesha | 150/52 R |
| 1,604,090 | 10/1926 | Wolfson | 150/52 R |
| 2,344,010 | 3/1944 | Walsh | 190/42 UX |
| 2,766,797 | 10/1956 | Cowen | 150/11 X |
| 3,545,659 | 12/1970 | Libby | 150/33 X |

FOREIGN PATENTS OR APPLICATIONS

| | | | |
|---|---|---|---|
| 11,081 | 5/1908 | United Kingdom | 150/11 |

*Primary Examiner*—Donald F. Norton
*Attorney, Agent, or Firm*—Steinberg and Blake

[57] ABSTRACT

A carrier for loose articles. The carrier preferably includes an elongated towel fixedly carrying inwardly of each of its opposed ends a pair of grommets which are situated adjacent opposed side edges of the towel, respectively. An elongated cord is formed into a loop and is fixed to the towel at one of the grommets. Articles which are to be carried can be placed at a central region of the towel, and then the loop can be passed through the remaining three grommets to gather them together while the loop extends therefrom and while the part of the towel which hangs from the gathered grommets and the loop forms a pouch-like enclosure in which articles, preliminarily placed at a central region of the towel, can be carried.

5 Claims, 4 Drawing Figures

CARRIER FOR LOOSE ARTICLES

BACKGROUND OF THE INVENTION

The present invention relates to carriers for articles of any type such as toilet articles, articles of clothing, and the like.

At the present time, conventional carriers for articles of this type are relatively bulky and complex. For example it is well known to provide suitable bags with many different types of closures and carrying handles. Thus such bags may have a slide-fastener type of closure or suitable buckles, clasps, and the like, and they usually have fixed thereto U-shaped carrying handles or the like. Such conventional carriers are relatively expensive as well as bulky and are inconvenient to carry about while being relatively expensive. In addition, such carriers have only a limited range of use inasmuch as they can only serve as carriers for the loose articles while being incapable of serving any other purpose.

SUMMARY OF THE INVENTION

It is accordingly a primary object of the present invention to provide a carrier which will avoid the above drawbacks.

Thus, it is an object of the present invention to provide an exceedingly inexpensive simple carrier for loose articles.

It is furthermore an object of the present invention to provide a carrier of this type which can, in addition to serving as a carrier, serve a completely separate additional function such as the function of a towel.

Furthermore, it is an object of the present invention to provide a carrier of the above type which is exceedingly flexible, its shape being determined by the articles which are carried, so that there is no limitation on the particular types of articles which can be carried.

Furthermore, it is an object of the present invention to provide a carrier of this type which is exceedingly simple to close and open while at the same time being capable of reliable holding articles therein and being convenient to carry about.

According to the invention the carrier includes a sheet material means of a predetermined configuration having a plurality of grommets fixed thereto at locations which are spaced from each other and from a central region of the sheet material means, the latter also having fixed thereto a single filamentary means at a location spaced from the central region of the sheet material means and spaced from the plurality of grommets. With this construction it is possible to place articles which are to be carried at the central region of the sheet material means, and then the single filamentary means can be passed through the plurality of grommets for gathering them together with the filamentary means extending therefrom while the sheet material means forms a pouch-like enclosure hanging from the grommets and capable of containing any desired articles.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
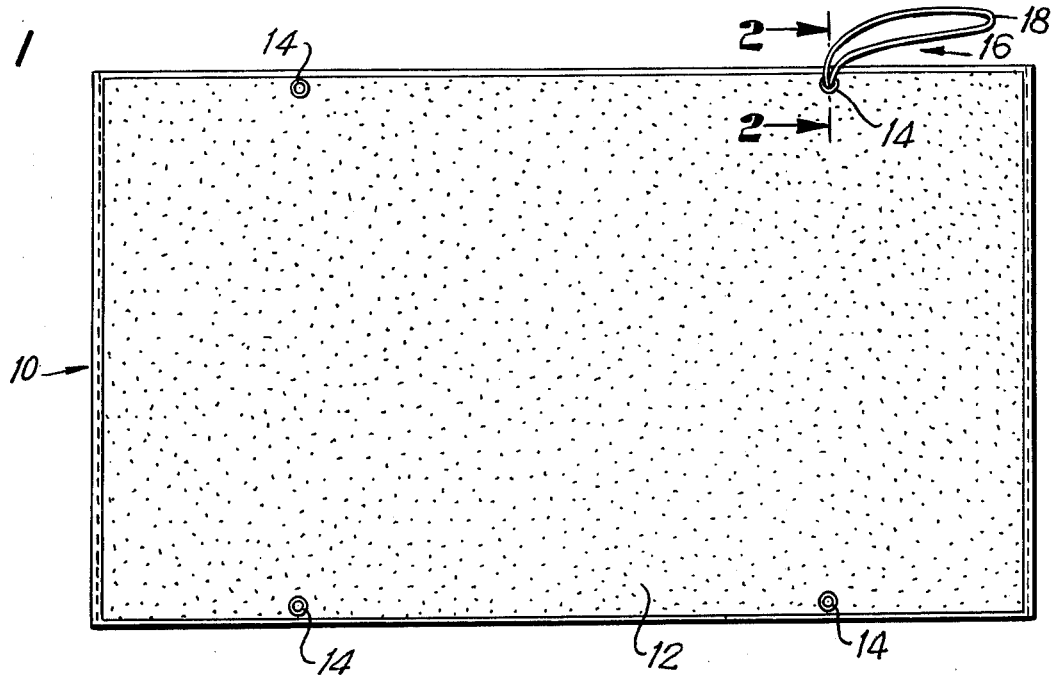
FIG. 1 is a top plan view of one possible embodiment of a carrier according to the invention.

Referring now to the drawings, the carrier 10 of the present invention is shown in FIG. 1 in a condition where it is ready to receive articles which are to be carried. The carrier 10 includes a sheet material means 12 which in the illustrated example is in the form of an elongated rectangular towel. A plurality of opening-forming means are carried by the sheet material means 12 and are illustrated as taking the form of grommets 14 which are fixed to the sheet material means 12. Thus, it will be seen that in the illustrated example there are four grommets 14. The left pair of grommets 14 of FIG. 1 are situated a substantial distance inwardly of the left end of the towel 12 while the right pair of grommets 14 of FIG. 1 are situated a substantial distance inwardly of the right end of the towel 12, as viewed in FIG. 1. It will be noted furthermore that all of the grommets are situated adjacent the opposed side edges of the towel and are spaced from each other as well as being spaced from the central region of the towel.

Figure 2:
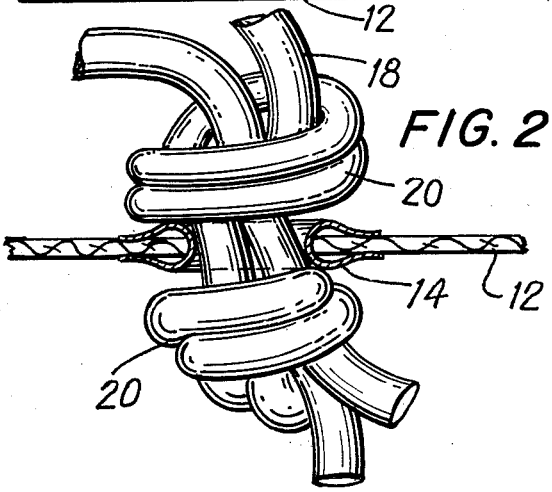
FIG. 2 is a fragmentary section taken along line 2—2 of FIG. 1 in the direction of the arrows and showing the manner in which the single filamentary means of the invention is fixed to the sheet material means.

A single filamentary means 16 is fixed to and extends from the sheet material means 12. This single filamentary means 16 takes the form of an elongated cord 18 which has the configuration of a loop. For the purpose of fixing the filamentary means 16 to the sheet material means 12, part of the cord 18 is passed through the grommet, as shown in FIG. 2, and is knotted on opposite sides of the grommet 14, as clearly shown in FIG. 2. The knots 20 are larger than the opening defined by the grommet 14 of FIG. 2, so that in this way the filamentary means 16 is fixed with the sheet material means 12.

Figure 3:
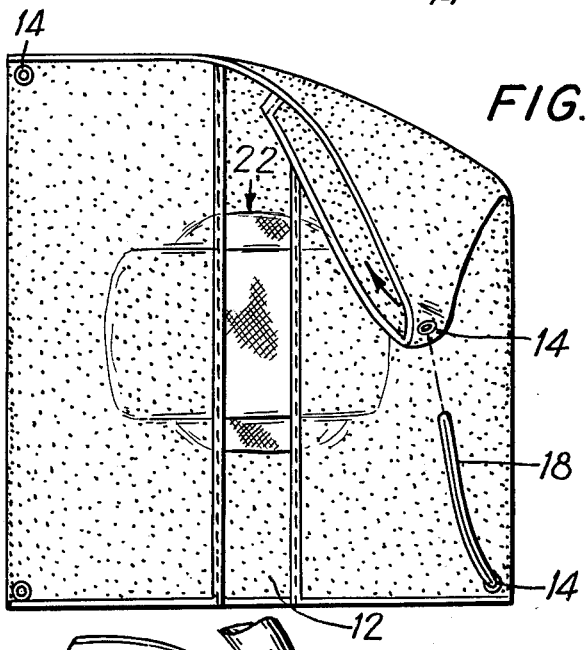
FIG. 3 illustrates the manner in which the carrier of the invention is manipulated.

Inasmuch as the sheet material means 12 in the illustrated example has the form of a towel, it can be used in the manner of any conventional towel for drying purposes, for example. When the sheet material means 12 is to function as a carrier, it is spread out as shown in FIG. 1, and articles which are to be carried are placed on the central region of the towel 12. Thus, FIG. 3 shows a number of articles 22 which have been placed on the central region of the towel. These articles 22 can be any desired articles such as toilet articles, articles of clothing, or the like. The towel 12 is shown in FIG. 3 in a condition where it has been turned over so that the loop 18 is located at the lower right hand part of the towel, as viewed in FIG. 3. When a number of articles 22 have been placed in the central region of the towel, the opposed ends thereof can be folded over toward the central region of the towel, as illustrated, so as to reduce the length thereof. Then the loop 18 is passed successively through the several grommets 14. Thus, FIG. 3 illustrates how the loop 18 is first passed through the upper right hand grommet of FIG. 3, and then it will be successively passed through the remaining two grommets, and there is no required sequence of passing the loop 18 through the several grommets. Thus the user can place the loop 18 successively through the several grommets 14 in any desired sequence.

Figure 4:
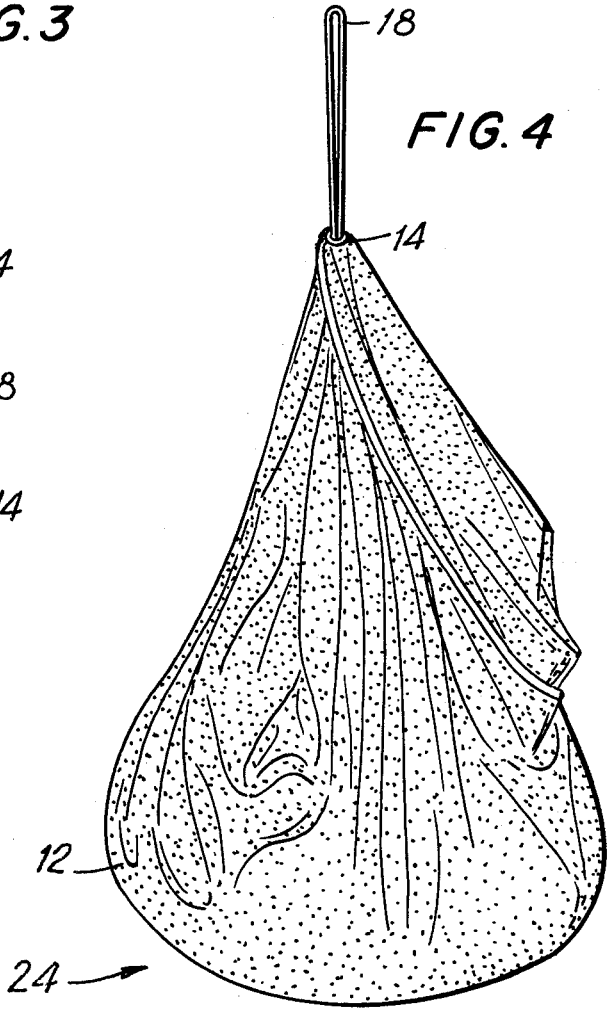
FIG. 4 shows the carrier of the invention in its carrying mode where articles are enclosed within the carrier.

After the loop has been placed through the grommets, they will be gathered together adjacent that part of the loop which is fixed to the grommet 14 shown in FIG. 2, just above the upper knot 20 which is shown in FIG. 2. The result is that the part of the towel 12 which hangs down from the gathered grommets forms a pouch-like enclosure 24 illustrated in FIG. 4 and containing the articles 22 therein. The loop 18, on the other hand, extends above the gathered grommets and forms a convenient means for carrying the carrier shown in FIG. 4. The carrier, when it has the configuration shown in FIG. 4, can easily be carried over a shoulder, or if preferred the loop 18 can be held by hand with the enclosure 24 hanging from the loop 18 in the manner shown in FIG. 4.

In order to open the carrier it is a simple matter to withdraw the filamentary means 18 from the several grommets so that the towel 12 can again be spread out and the articles removed therefrom.

Thus, through this exceedingly simple and inexpensive structure it is possible to form an exceedingly flexible carrier in that any desired articles can conveniently be carried therein with the size and shape of the pouch-like enclosure 24 adapting itself to the group of articles which are to be carried. Moreover, when the articles have been removed from the carrier, the carrier can be used as a towel. Thus, the structure of the invention is particularly suitable for trips to the seashore or to swimming pools or the like, as well as for general travelling purposes where the traveler wishes to carry in the most convenient manner articles which may be required for use when away from home.

What is claimed is:

1. A carrier for loose articles, comprising sheet material means of a predetermined configuration capable of being spread out to receive one or more loose articles at a substantially central region of said sheet material means, a plurality of grommets fixed to said sheet material means at spaced parts thereof beyond said central region and defining openings passing through said sheet material means, and a single filamentary means fixed to and extending from said sheet material means at a location beyond said central region thereof and spaced from said grommets, whereby said single filamentary means can be passed through said plurality of grommets to gather them together for forming from said sheet material means a pouch-like enclosure capable of hanging down from the gathered grommets with one or more articles therein while the filamentary means facilitates carrying the enclosure, said sheet material means having an elongated substantially rectangular configuration and said plurality of grommets including one pair of grommets fixed to said sheet material means inwardly of one end thereof and adjacent opposed side edges thereof while a third grommet and said filamentary means are fixed to said sheet material means inwardly of an opposed end thereof and respectively adjacent said opposed side edges thereof, whereby beyond said pair of grommets and beyond said third grommet and said filamentary means there are free end regions of said sheet material means which can be folded inwardly toward said central region prior to passing said filamentary means through said three grommets.

2. The combination of claim 1 and wherein said sheet material means is a towel.

3. The combination of claim 2 and wherein said filamentary means is in the form of a length of cord and has the configuration of an elongated flexible loop.

4. The combination of claim 3 and wherein an additional, fourth grommet is fixed to said towel at the location of said loop, and the cord which forms said loop having a portion extending through said fourth grommet and knotted on opposite sides of said fourth grommet for fixing said cord to said towel.

5. A carrier for loose articles, comprising sheet material means of a predetermined configuration capable of being spread out to receive one or more loose articles at a substantially central region of said sheet material means, a plurality of opening-forming means carried by said sheet material means at spaced parts thereof beyond said central region and respectively defining openings, and a single filamentary means fixed to and extending from said sheet material means at a location beyond said central region thereof and spaced from said plurality of opening-forming means, whereby said single filamentary means can be passed through said openings of said plurality of opening-forming means to gather them together for forming from said sheet material means a pouch-like enclosure capable of hanging down from the gathered plurality of opening-forming means with one or more articles therein while filamentary means facilitates carrying the enclosure, said sheet material means having an elongated substantially rectangular configuration and said plurality of opening-forming means including one pair of opening-forming means carried by said sheet material means inwardly of one end thereof and adjacent opposed side edges thereof while a third opening-forming means and said filamentary means are carried by said sheet material means inwardly of an opposed end thereof and respectively adjacent said opposed side edges thereof, whereby beyond said pair of opening forming means and beyond said third opening-forming means and said filamentary means there are free end regions of said sheet material means which can be folded inwardly towards its central region prior to passing said filamentary means through said openings of said three opening-forming means.

* * * * *